US008950724B2

(12) United States Patent
Hurst et al.

(10) Patent No.: US 8,950,724 B2
(45) Date of Patent: Feb. 10, 2015

(54) TURBINE ENGINE MOUNTING SYSTEM AND METHOD

(75) Inventors: Kenneth Hurst, La Mesa, CA (US); Edward Sieveking, San Diego, CA (US); Kwok-Kwong Ben Tse, San Diego, CA (US); Eric Blankenship, San Diego, CA (US)

(73) Assignee: Solar Turbines Inc., San Diego, CA (US)

( * ) Notice: Subject to any disclaimer, the term of this patent is extended or adjusted under 35 U.S.C. 154(b) by 197 days.

(21) Appl. No.: 13/535,539

(22) Filed: Jun. 28, 2012

(65) Prior Publication Data

US 2014/0001335 A1 Jan. 2, 2014

(51) Int. Cl.
*B64D 27/00* (2006.01)

(52) U.S. Cl.
USPC ..... 248/554; 244/54

(58) Field of Classification Search
USPC ..... 248/554, 555, 556, 557, 188.4; 244/54; 60/796, 797
See application file for complete search history.

(56) References Cited

U.S. PATENT DOCUMENTS

| | | | | |
|---|---|---|---|---|
| 4,050,660 | A | 9/1977 | Eggmann et al. | |
| 4,057,371 | A | 11/1977 | Pilarczyk | |
| 5,690,304 | A | 11/1997 | Folkens | |
| 6,131,850 | A * | 10/2000 | Hey et al. | 244/54 |
| 6,260,351 | B1 | 7/2001 | Delano et al. | |
| 6,296,203 | B1 * | 10/2001 | Manteiga et al. | 244/54 |
| 6,328,293 | B1 * | 12/2001 | Olsen | 267/140.11 |
| 6,330,985 | B1 * | 12/2001 | Manteiga et al. | 244/54 |
| 6,607,165 | B1 | 8/2003 | Manteiga et al. | |
| 6,776,370 | B2 * | 8/2004 | Struzik et al. | 244/17.27 |
| 6,843,449 | B1 * | 1/2005 | Manteiga et al. | 244/54 |
| 7,950,605 | B2 | 5/2011 | Howard et al. | |
| 8,028,967 | B2 | 10/2011 | Busekros et al. | |
| 2005/0081531 | A1 | 4/2005 | Stretton et al. | |
| 2009/0056343 | A1 | 3/2009 | Suciu et al. | |
| 2009/0064685 | A1 | 3/2009 | Busekros et al. | |
| 2009/0314881 | A1 | 12/2009 | Suciu et al. | |

FOREIGN PATENT DOCUMENTS

| | | |
|---|---|---|
| GB | 1433479 A | 4/1976 |
| KR | 1020090086804 | 8/2009 |

* cited by examiner

*Primary Examiner* — Steven Marsh
(74) *Attorney, Agent, or Firm* — Procopio, Cory, Hargreaves & Savitch LLP

(57) ABSTRACT

A mounting system is provided to couple an engine unit including a turbine engine portion coupled to a gearbox portion about an axial axis to a support structure. An aft mounting device can couple the turbine engine portion to the support structure. A force determinator can be configured to determine a force load of the engine unit at the location of the aft mounting device. The length of the aft mounting device is adjustable between the turbine engine portion and the support structure in a radial direction to substantially align the gearbox portion and the engine portion relative to the axial axis. The aft mounting device may be sized to a desired length to correspond to a force load of the engine unit during the running condition.

20 Claims, 4 Drawing Sheets

TURBINE ENGINE MOUNTING SYSTEM AND METHOD

TECHNICAL FIELD

The present disclosure relates generally to a system and method for mounting a turbine engine and, more particularly, to a system and method for mounting and leveling a turbine engine with a gearbox.

BACKGROUND

Gas turbine systems include a rotor unit mounted to rotate inside a stationary external housing and generally have a gearbox that is mounted to the external housing. The gearbox is generally positioned adjacent the turbine engine and coupled in a manner to use power from the turbine engine to drive the engine's accessories such as electrical generators, fluid pumps, and heat exchangers for cooling oil or heating fuel. At least two supports, longitudinally spaced apart, are used to bear various loads of the engine and its gearbox, for example, the turbine engine is mounted at its aft end and mounts to the gearbox at the forward end. The loads typically include vertical loads such as engine weight, axial loads due to engine generated thrust, and lateral and roll loads depending on the engine's application.

Aft engine mounts typically are provided with a spring or other biasing member to provide a spring force to the engine in the vertical direction. However, spring loaded aft mounts have proved to behave inconsistently, with difficulty in highly variable spring forces (up to 1000 pounds), in provision of nonplanar surfaces, and in maintaining consistent leveling. Because of defective aft mounts, the engine cantilevers and causes gearbox misalignment with the engine. As a result, one or more gears within the gearbox experiences additional loading to cause excessive wear on the teeth. Hence, the gearboxes of engines with spring loaded aft mounts can be susceptible to failure due to the engine not being fully supported and/or excessive variability in engine position. Further, setup of spring loaded aft mounts by a technician can be highly variable.

One device and method for mounting is described in U.S. Pat. No. 8,028,967 To Busekros et al. In particular, this patent discloses a gas turbine engine mounted on a base frame via a support. The support provides a support face in operational engagement with the base frame by way of a plurality of support plate elements. Merely changing the arrangement of only the support plates makes it possible to make later adjustments to the mounting of the a gas turbine system in order to minimize vibration and bear the weight of the engine. A lifting device is provided to briefly raise the gas turbine engine such that the support plates' arrangement can be modified.

SUMMARY

In one example, a mounting system is provided to couple an engine unit including a turbine engine portion coupled to a gearbox portion about an axial axis to a support structure. An aft mounting device can couple the turbine engine portion to the support structure. A force determinator can be configured to determine a force load of the engine unit at the location of the aft mounting device. The length of the aft mounting device is adjustable between the turbine engine portion and the support structure in a radial direction, which is substantially transverse to the axial axis, to substantially align the gearbox portion and the engine portion relative to the axial axis. The engine unit may have a determinable force load at an engine running condition. At the engine running condition, the engine unit may be capable of thermal expansion along the axial axis and in the radial direction, and the aft mounting device may be sized to a desired length to correspond to the determinable force load to substantially align the gearbox portion and the engine portion relative to the axial axis during the running condition.

In one example, a method of aligning a gearbox portion and an engine portion of an engine unit relative to an axial axis is provided. The method can include one or more of the following steps. For example, a force load of the engine unit at a location of an aft mounting device coupled between the engine portion and a support structure can be determined with a force determinator. A length of the aft mounting device between the engine portion and the support structure in a radial direction, which is substantially transverse to the axial axis, can be determined. The length may correspond to the force load. At least one of the force load and the length of the aft mounting device can be adjusted to substantially align the gearbox portion and the engine portion relative to the axial axis.

In one example, a mounting device to couple a thermally expandable structure to a support structure is provided. A first mounting segment can couple to a thermally expandable structure. A second mounting segment can couple to a support structure. A connecting rod can be coupled between the first and second mounting segments. The connecting rod may include a first end pivotably coupled to the first mounting device and/or a second end pivotably coupled to the second mounting device to permit axial movement of the thermally expandable structure along an axial axis during thermal expansion. The connecting rod can be adjustable to adjust the length of the mounting device between the thermally expandable structure and the support structure in a radial direction, which is substantially transverse to the axial axis. The mounting device may include a force determinator.

DETAILED DESCRIPTION

Figure 1:
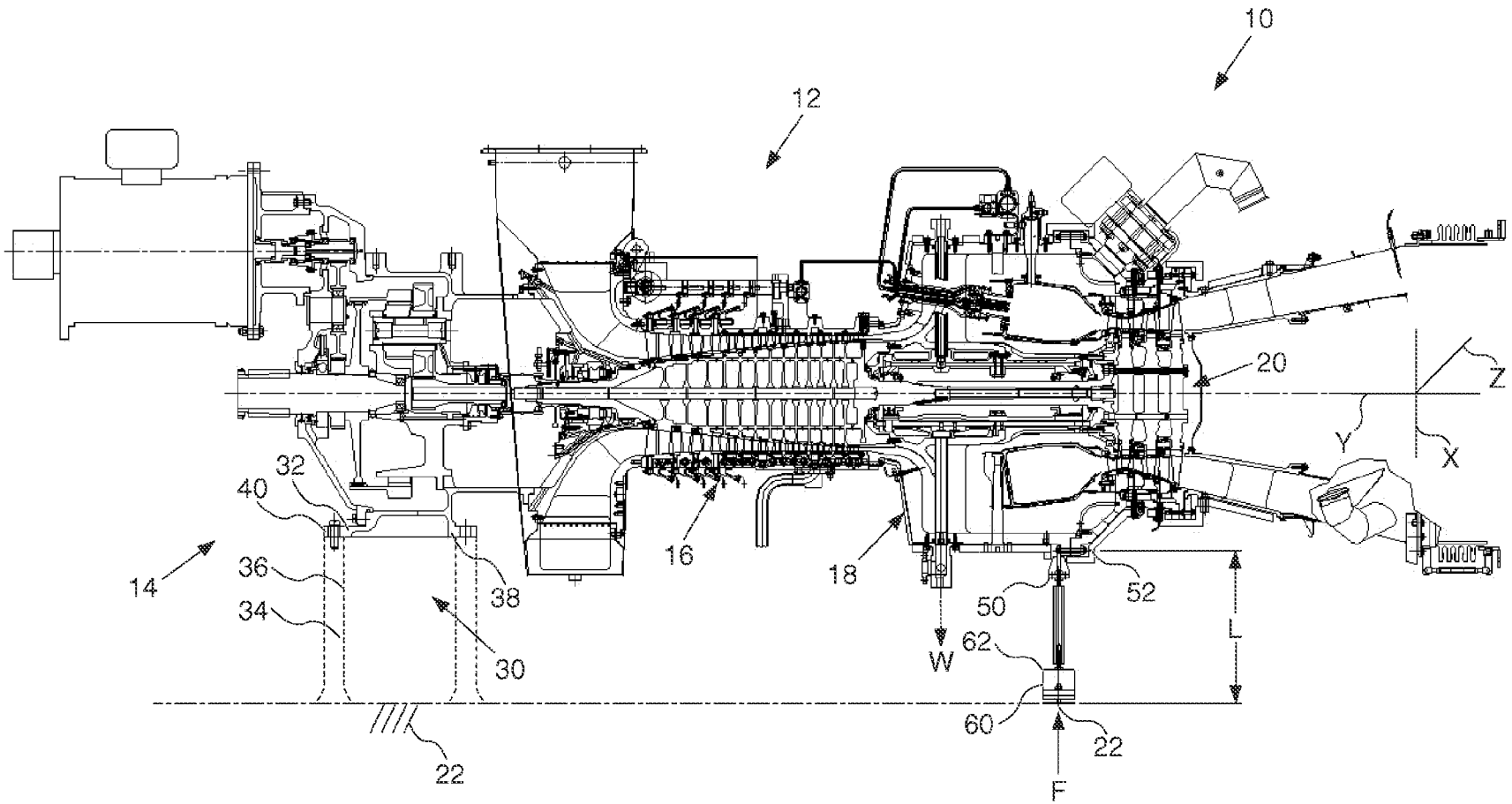
FIG. 1 is a diagrammatic illustration of an exemplary disclosed engine unit.

FIG. 1 illustrates one example of an engine unit 10 that can include a turbine engine 12 and a gearbox 14 (shown partially in dashed lines). The turbine engine 12 may include a fan section (not shown), a compression section 16, a combustor section 18, and a turbine section 20. The sections may be arranged in the order shown in the figures, in axial flow relationship. Air can enter the engine through the fan section (if provided) and the compression section 16, where the air can be pressurized in each section. Compressed air leaving the compression section 16 can enter the combustor section 18, where air can be mixed with fuel and burned to provide a high-energy gas stream. The high-energy gas stream leaving the combustor section 18 can enter the turbine section 20, where it can be expanded. Energy extracted during expansion of the high-energy gas stream can be directed to drive the fan section (if provided) and the compression section 16. Air can also bypass the core engine to produce a portion of the engine thrust. These sections can contain one or more rotatable elements, such as additional compressors or turbines (not shown), which rotate about a central rotational axis Y. An external housing (not shown) may house the respective sections. The housing can provide the main structural support for the engine and may be constructed of one or more casing sections that can be joined together by various attachment mechanisms such as bolted flanges. The engine unit 10 can be mounted to a support structure 22 at one or more mounting locations, as will be described herein. The engine unit 10 may thermally expand during a running condition in an axial direction along the axis Y and/or in a radial direction along a radial axis X.

The gearbox 14 may be mounted to the external housing of the turbine engine 12. The gearbox 14 can be used to transmit power from the turbine engine 12 to drive one or more accessories (not shown), such as, for example, generators for electricity, pumps for circulating fluids, heat exchangers for cooling oil or heating fuel, any other accessories or combinations thereof known in the art. Each accessory can be mounted on the gearbox 14.

In FIG. 1, the gearbox 14 may be mounted at a forward end of the engine's housing by a forward mounting device 30 to couple to a gearbox portion 32 to the support structure 22. In one example, the forward mounting device 30 may couple the gearbox portion 32 and the support structure 22 in a secure manner to substantially inhibit axial and/or radial relative movement therebetween. The forward mounting device 30 may include a flat stand 34 having an upright portion 36 extending from the support structure 22 and a planar portion 38 substantially transverse to the upright portion 36. The planar portion 38 can be coplanar with a mounting flange 40 of the gearbox 14. To this end, the planar portion 38 and the mounting flange 40 can include aligning openings for receiving mechanical fasteners, such as bolts, or alternatively, the planar portion 38 and the mounting flange 40 can be fixed together by other known joining mechanisms such as welding, adhesives, and the like. The forward mounting device 30 may be configured to transmit deflection and distortion of the gearbox. In one example, the flat stand 34 can be a "L-shaped" member with the upright portion 36 and the planar portion 38 forming the legs.

In FIG. 1, an aft mounting device 50 may also be provided. The aft mounting device 50 can be coupled between a turbine engine portion 52 and the support structure 22. The aft mounting device 50 may be configured to permit axial movement of the engine unit 10 during thermal expansion. The aft mounting device 50 may be configured to permit radial movement of the engine unit 10 during thermal expansion and to inhibit radial movement of the engine unit 10 after thermal expansion. In one example, during thermal expansion of the engine unit 10, the aft mounting device 50 may be configured to permit axial movement of the engine unit and radial movement of the engine unit.

The aft mounting device 50 may include a force determinator 60 to determine a force load of the engine unit 10 at a location of the aft mounting device 50. The aft mounting device 50 may be positioned axially from the center of gravity of the turbine engine 12. In one example, the force determinator 60 may include a strain gauge such as found in a load cell or a calibrated spring scale. However, other arrangements of force determinators can be used, such as, for example, placing a strain gauge directly on the engine unit to determine the load. It can be appreciated that other mechanisms can be used by persons of ordinary skill in the art to determine the load of the engine unit.

A support housing 62 can at least partially contain the force determinator 60. In one example, the force determinator 60 includes a strain gauge to measure the deformation as an electrical signal, because the strain changes the effective electrical resistance of wires. The electrical signal can be carried by one or more conductors to a controller having a display for display numerically or otherwise indicate such as with graphs the force load, such as a part of a handheld device. It will be appreciated that the controller can be a computing device, e.g., a processor, which can read computer-executable instructions from a computer-readable medium and can execute those instructions. Media that are readable by a computer can include both non-transitory and transitory media. Examples of the former include magnetic discs, optical discs, flash memory, RAM, ROM, tapes, cards, etc. Examples of the latter include acoustic signals, electrical signals, AM and FM waves, etc.

The length L of the aft mounting device 50 between the turbine engine portion 52 and the support structure 22 can be adjustable to substantially align the gearbox 14 and the turbine engine 12 about the axial axis Y during an engine running condition. The length L can vary a force load F exerted by the engine unit to the aft mounting device 50. To this end, the engine unit 10 can have an initial force load when the engine unit is at a rest condition. The force load can be different from the initial force load when the engine unit is at an engine running condition due to thermal growth. In response to the engine unit 10 running, the length of the aft mounting device 50 can be adjustable to a desired length corresponding to a desired force load. At the desired length, the gearbox portion and the engine portion can be substantially aligned about the axial axis.

Figure 2:
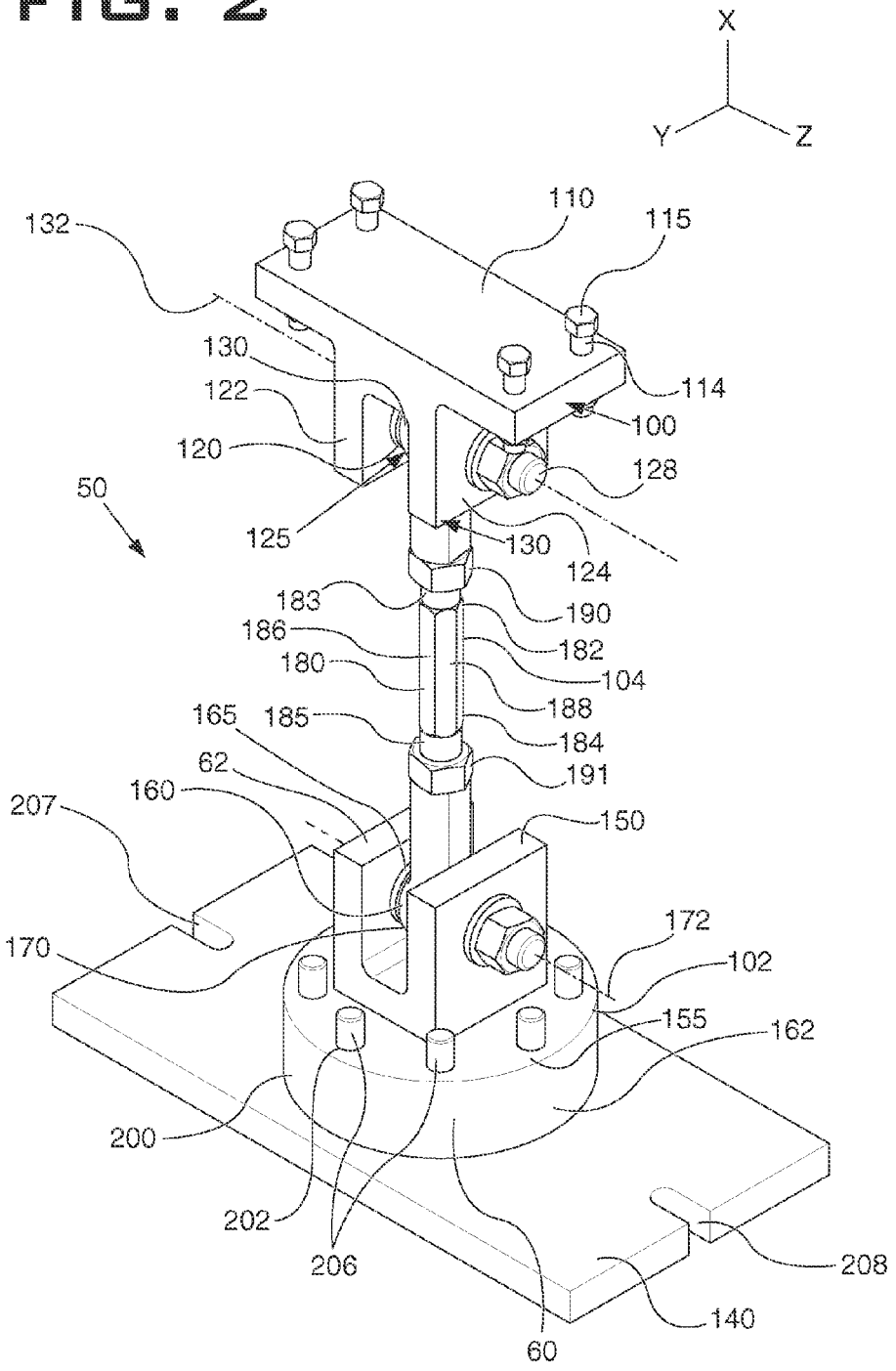
FIG. 2 is a perspective view of an exemplary disclosed aft mounting device that may be used with the engine unit of FIG. 1.
Figure 3:
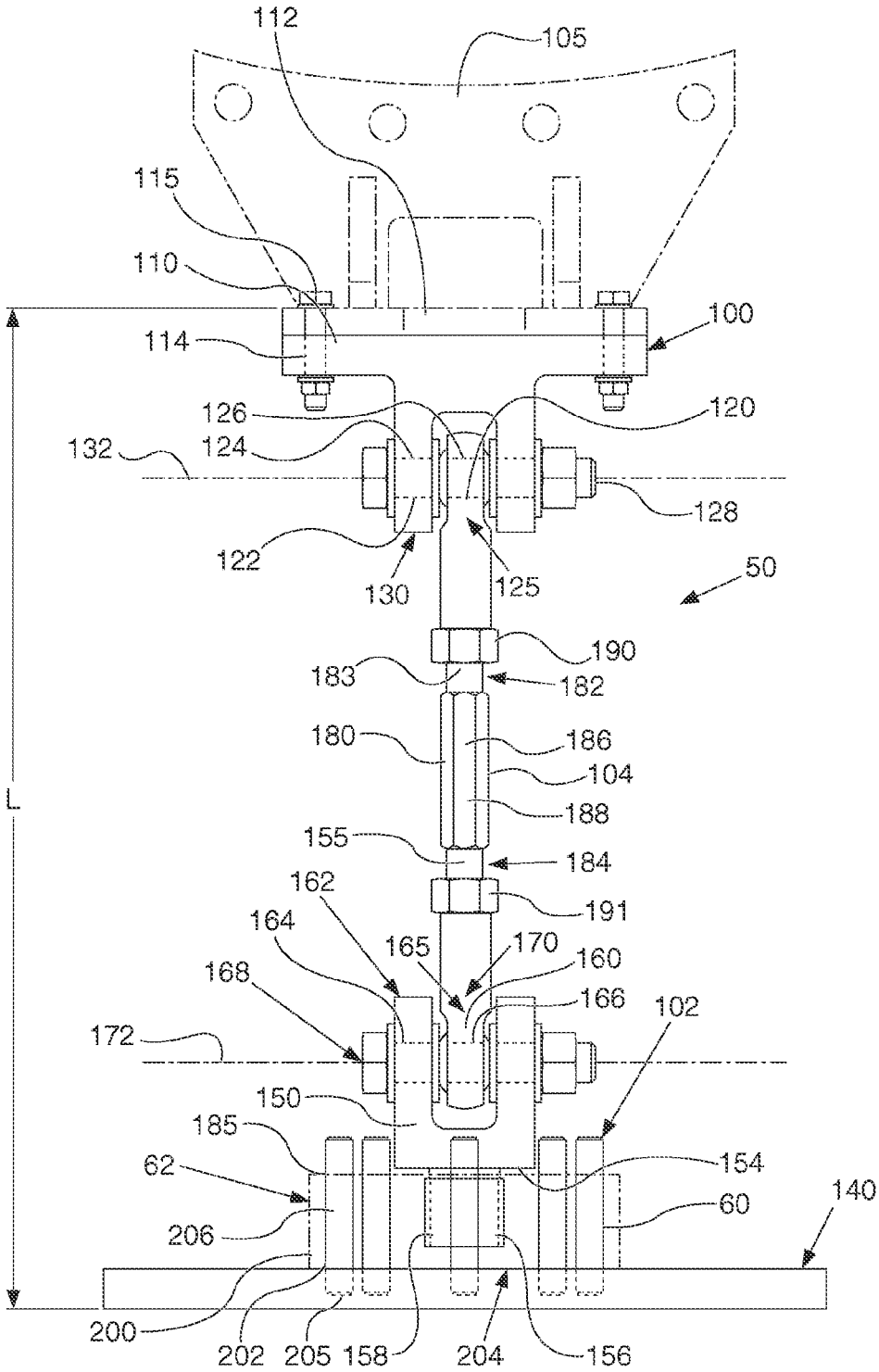
FIG. 3 is a side view of an exemplary disclosed aft mounting device of FIG. 2.

FIGS. 2-3 illustrate one example of the aft mounting device 50. The aft mounting device 50 can include a first mounting segment 100 to couple to the turbine engine portion 52, a second mounting segment 102 to couple to the support structure 22, and a connecting rod 104 coupled between the first and second mounting segments 100, 102. The first mounting segment 100 can be coupled to a mounting plate 105 extending from the turbine engine portion 52. The first mounting segment 100 can have a mounting surface 110 for engaging the mounting plate 105. The mounting surface 110 can be coplanar with a flange 112 of the mounting plate 105. To this end, the mounting surface 110 and the flange 112 can include aligning openings 114 for receiving corresponding mechanical fasteners 115, such as bolts, therethrough. Alternatively, the mounting surface 110 and the flange 112 can be fixed together by other known joining mechanisms such as welding, adhesives, and the like.

The connecting rod 104 may include a first end 120 pivotably coupled to the first mounting segment 100. To this end, the first mounting segment 100 may have one or more legs 122 depending from the mounting surface 110 away from the mounting plate 105. Each leg 122 may have an opening 124. In one example, the legs 122 of the first mounting segment 100 may form a clevis joint with the first end 120 of the connecting rod 104. To this end, a pair of legs 122 can be spaced apart to define a notch 125 for receiving the first end 120 of the connecting rod 104. Openings 124 formed within the legs 122 can be aligned with an opening 126 formed in the first end 120 such as to receive a coupling pin 128 and form a first pivot attachment 130 about a first pivot axis 132. The coupling pin 128 can include a mechanical fastener such as a nut and bolt combination. The first pivot axis 132 can be substantially transverse to the axial axis Y and the radial axis X and substantially transverse to a third axis Z. To this end, the first pivot attachment 130 can allow relative movement between the engine unit 10 and the support structure 22 in either direction along the axial axis Y.

The second mounting segment 102 can be coupled to a mounting plate 140 of the support structure 22. The second mounting segment 102 can include a mounting bracket 150 extending from the support housing 62. The mounting bracket 150 can have an interface surface 154 for facing a mounting surface 155 of the support housing 62. The interface surface 154 can be coplanar with the mounting surface 155 of the support housing 62. To this end, the mounting bracket 150 can be securely fixed relative to the mounting surface 155 of the support housing 62 by any know joining mechanism, such as, for example, mechanical fasteners, welding, adhesives, and the like. In one example, the mounting bracket 150 can include a threaded stud 156 extending the interface surface 154. To this end, the support housing 62 can include a threaded opening 158 sized to threadably receive the threaded stud 156, as shown in FIG. 3.

The connecting rod 104 may include a second end 160 pivotably coupled to the second mounting segment 102. To this end, the mounting bracket 150 may have one or more legs 162 depending from the interface surface 154 away from the adjacent support structure 22. Each leg 162 may have an opening 164. In one example, the legs 162 of the mounting bracket 150 may form a clevis joint with the second end 160 of the connecting rod 104. To this end, a pair of legs 162 can be spaced apart to define a notch 165 for receiving the second end 160 of the connecting rod 104. Openings 164 formed within the legs 162 can be aligned with an opening 166 formed in the second end 160 such as to receive a coupling pin 168 and form a second pivot attachment 170 about a second pivot axis 172. The coupling pin 168 can include a mechanical fastener such as a nut and bolt combination. The second pivot axis 172 can be substantially transverse to the axial axis Y and the radial axis X and substantially parallel to the third axis Z. To this end, the second pivot attachment 170 can allow relative movement between the engine unit 10 and the support structure 22 in either direction along the axial axis Y. The first and/or second pivot attachments 130, 170 can permit the engine unit 10 to move axially during thermal expansion without affecting the operation of the force determinator 60. To this end, the force determinator 60 may be substantially isolated from axial movement of the engine unit.

The connecting rod 104 can be configured to adjust the length L of the aft mounting device 50 between the turbine engine portion 52 and the support structure 22 along the radial axis X. To this end, the connecting rod 104 includes an adjustable segment 180 coupled between the first end 120 and the second end 160 of the connecting rod 104. In one example, the adjustable segment 180 can be coupled between the first end 120 and the second end 160 in a manner to form a turnbuckle joint. Here, the adjustable segment 180 can be formed as a turnbuckle rod having a first end 182 and a second end 184 with corresponding threaded end portions 183, 185 (can be threaded in opposite directions) and an intermediate body portion 186 formed with planar engaging surfaces 188. The body portion 186 may have a cross-section in the shape of a triangle, rectangle, hexagon, octagon, or any other geometrically regular or irregular shape including curvilinear portions. The first and second ends 120, 160 of the connecting rod 104 may also have threaded portions (not shown) for threadably engaging the corresponding threaded end portions 183, 185 of the first and second ends 182, 184 of the adjustable segment 180. For example, the first and second ends 120, 160 of the connecting rod 104 may have a threaded recess formed in its body or may have threaded fastener nuts 190, 191 as shown fixedly attached to the body of the corresponding first and second ends 120, 160. When coupled, rotation of the body portion 186 of the adjustable segment 180 in either direction relative to the first and second ends 120, 160 can move the first end 120 and the second end 160 closer to one another or farther apart from one another. As a result, the length L of the aft mounting device 50 can be adjusted along the radial axis X. It can be appreciated by those skilled in the art that other examples can be used to adjust the length, such as, for example, a screw jack, a scissor jack, a hydraulic cylinder, and the like.

The support housing 152 can include a body 200 that can be disposed between the mounting bracket 150 and the mounting plate 140. The body 200 may be cylindrical or disk-like, such as shown, or can be any other shape. The body 200 can be fixedly secured to the mounting plate 140. For example, the body 200 of the support housing 152 may include one or more throughbores 202 extending between the mounting surface 155 and a surface 204 opposite the mounting surface 155 that engages the mounting plate 140. In the example shown, eight throughbores 202 can be formed circumferentially in the body 200. The mounting plate 140 may include openings 205. The openings 205 can be formed in a pattern similar to the pattern of the throughbores 202 of the body 200 of the support housing 152. The openings 205 and throughbores 202 can be aligned for receiving threaded fasteners 206 for a secure engagement, although other joining mechanisms besides or in addition to the threaded fasteners 206, may be used such as welding, adhesives, or the like. The support housing 152 including the force determinator 60 may be fixed in the manner such as to not rotate or move axially along axes Y, Z relative to the support structure 22. The mounting plate may include one or more slots 207, 208 that may be formed in its ends to facilitate attachment to the support structure. The slots 207, 208 can allow for variation along the axis Z for easier installation.

In one aspect, the support housing 152 and the force determinator 60 can be integrated into a single unit. Regardless, the force determinator 60 or the integrated single unit can be removable from the aft mounting device 50, and thus can be removably attached to the mounting plate 140. As will be further described below, when the operator has made a final determination of the load force and/or length, the force determinator 60 may be removed and replaced with a blank or a spacer similarly configured like the support housing and/or force determinator.

INDUSTRIAL APPLICABILITY

The present disclosure relates to mounting and leveling a turbine engine, and in particular, one with a gearbox. When the turbine engine is not level or in alignment with the gearbox, the turbine engine can become cantilevered, resulting in deflection of greater than, for example, about 0.0003 inch/inch relative to the axial axis Y, and additional stress placed on the gearbox, which may lead to possible gearbox failure. The present disclosure can provide a solid mount that may be adjustable and may include a force determinator device such as a strain gauge. The solid mount can be adjusted until a reading from the load cell reaches a desired level sufficient to inhibit cantilevering, for example, up to about 0.0001 inch/inch relative to the axial axis Y. The mount can also inhibit gearbox failure, especially caused by axial and radial thermal expansion and contraction of the engine unit during engine running condition, which can account for axial movement of greater than about 0.2 inches and for radial movement of greater than about 0.12 inches. The aft mounting device can provide more consistent and accurate force loading and bearing for an engine unit. Further, the aft mounting device may avoid the manual, arbitrary, and inconsistent setup performed by technicians, thereby reducing setup time and failure.

Figure 4:
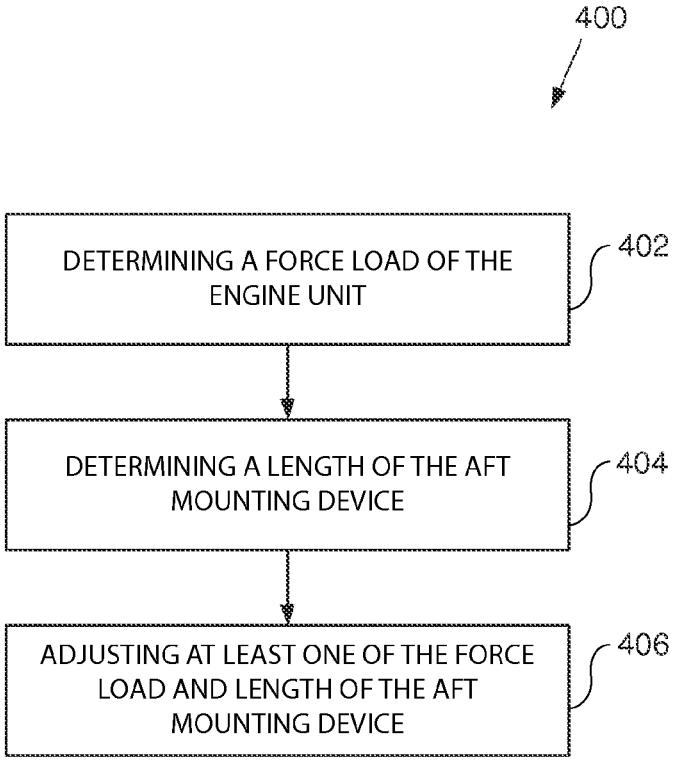
FIG. 4 is a schematic depicting an exemplary method of aligning an engine unit.

For example, the engine portion can be substantially aligned with the gearbox portion of the engine unit about an axial axis with one or more of the following steps of a method 400, with reference to FIG. 4. In step 402, a force load of the engine at a location of the aft mounting device can be determined with the force determinator. For example, an electric signal indicative of the force can be sent to a processor and displayed numerically by a display, such as a handheld device. In step 404, the length of the aft mounting device between the turbine engine portion and the support structure can be adjusted in the radial direction to substantially align the gearbox portion and the engine portion about the axial axis. The length and the force load can correspond to one another, and each one or both can be used as parameters to achieve the desired length and desired force load during the engine running condition. In step 406, at least one of the force load and the length of the aft mounting device can be adjusted to substantially align the gearbox portion and the engine portion relative to the axial axis, and in particular, to achieve alignment during an engine running condition where thermal growth of the engine unit may occur.

The engine unit has an initial force load at an engine rest condition. The force load may adjust to a specified force load at an engine running condition. The engine unit may have a variable force load during the engine running condition between a minimum running condition and a maximum running condition. The force load of the engine may be monitored with the force determinator between the minimum running condition and the maximum running condition. The engine unit may have a maximum force load at the maximum running condition. The length of the aft mounting device can be adjusted to a length to correspond to the maximum force load.

In one example, during the engine rest condition, the force determinator may be preset to a force load for the engine running condition based on the gearbox flange datum, engine weight and center of gravity and aft mounting, center of gravity of the gearbox, and other factors. Based on the preset force load, the aft mounting device may have a preset length for the engine running condition. A differential distance to change the preset length of the aft mounting device can be determined, e.g., based on experimental data. For example, a test can be conducted to determine the amount of force on the aft mount per change in unit length of the aft mount by measuring thermal growth using a dial gauge or calculated thermal growth based on measured temperatures.

The length of the aft mounting device can be changed by the differential distance to a subsequent length such that during the engine rest condition there can be predesigned misalignment between the engine portion and the gearbox portion. For example, the connecting rod can be adjusted as described herein. To this end, when the engine unit is at its engine running condition and thermal expansion is allowed to occur, the aft mounting device at its subsequent length can accommodate for radial and axial expansion changes of the engine unit. The aft mounting device at its subsequent length can be sufficient to permit substantially alignment between the gearbox portion and the engine portion about the axial axis.

In another example, during the engine rest condition, the length of the aft mounting device may be preset to a length for the engine running condition based on the gearbox flange datum, engine weight and center of gravity and aft mounting, center of gravity of the gearbox, and other factors. Based on the preset length, the aft mounting device may have a preset force load for the engine running condition based on the preset length. A differential force load to change the preset force load of the aft mounting device can be determined. The force load of the aft mounting device can be changed by the differential load to a subsequent force load such that during the engine rest condition there can be predesigned misalignment between the engine portion and the gearbox portion. For example, the force determinator can be adjusted. To this end, when the engine unit is at its engine running condition and thermal expansion is allowed to occur, the aft mounting device at its subsequent force load can accommodate for radial and axial expansion changes of the engine unit. The aft mounting device at its subsequent force can be sufficient to permit substantially alignment between the gearbox portion and the engine portion about the axial axis.

After the desired adjustments, the support housing and/or force determinator may be removed and replaced with a blank or a spacer similarly configured like the support housing and/or force determinator.

It will be apparent to those skilled in the art that various modifications and variations can be made to the disclosed mounting system and method. Other embodiments will be apparent to those skilled in the art from consideration of the specification and practice of the disclosed mounting system and method. It is intended that the specification and examples be considered as exemplary only, with a true scope being indicated by the following claims and their equivalents.

What is claimed is:

1. A mounting system to couple an engine unit to a support structure, the engine unit including a turbine engine portion coupled to a gearbox portion about an axial axis, the system comprising:

an aft mounting device to couple a turbine engine portion to a support structure; and a force determinator configured to determine a force load of the engine unit at a location of the aft mounting device, wherein a length of the aft mounting device is adjustable between the turbine engine portion and the support structure in a radial direction substantially transverse to the axial axis and is sized to a desired length to correspond to a determinable force load at an engine running condition of the engine unit to substantially align the gearbox portion and the turbine engine portion relative to the axial axis, the determinable force load including forces due to thermal expansion in the axial and radial directions.

2. The system of claim 1, wherein the aft mounting device is configured to permit axial movement of the engine unit during thermal expansion.

3. The system of claim 1, wherein the aft mounting device is configured to inhibit radial movement of the engine unit after thermal expansion.

4. The system of claim 1, wherein the aft mounting device is configured to vary response of the force load of the aft mounting device when the length is adjusted.

5. The system of claim 1, wherein the aft mounting device is configured to inhibit radial movement of the engine unit during thermal expansion.

6. The system of claim 1, wherein the aft mounting device includes a first mounting segment to couple to the turbine engine portion, a second mounting segment to couple to the support structure, and an adjustable connecting rod coupled between the first and second mounting segments.

7. The system of claim 6, wherein the adjustable connecting rod includes a first end pivotably coupled to the first mounting segment.

8. The system of claim 6, wherein the adjustable connecting rod includes a second end pivotably coupled to the second mounting segment.

9. The system of claim 6, wherein the second mounting segment includes a support housing to at least partially contain the force determinator.

10. A mounting device to couple a thermally expandable structure to a support structure, comprising:

a first mounting segment to couple to a thermally expandable structure;

a second mounting segment to couple to a support structure;

a connecting rod coupled between the first and second mounting segments, the connecting rod including a first end pivotably coupled to the first mounting segment and a second end pivotably coupled to the second mounting segment to permit axial movement of the thermally expandable structure along an axial axis during thermal expansion, wherein the connecting rod is adjustable to adjust a length of the mounting device between the thermally expandable structure and the support structure in a radial direction substantially transverse to the axial axis; and a force determinator configured to determine a force load of the thermally expandable structure at a coupling location, the force determinator including a strain gauge.

11. The device of claim 10, wherein the second mounting segment includes a support housing to at least partially contain the force determinator, the support housing with the force determinator removably attached to the support structure.

12. The device of claim 10, wherein the connecting rod includes an intermediate body portion threadably attached to each of the first end and the second end, wherein, in response to rotation of the intermediate body portion, the first end and the second end move relative to one another.

13. The device of claim 10, wherein the force determinator is removably attached to the aft mounting device.

14. The device of claim 10, wherein the couplings between the connecting rod and the first and second mounting segments are configured to inhibit radial movement of the engine unit during thermal expansion of the thermally expandable structure.

15. A mounting device to couple an engine unit capable of thermal expansion in both the axial and radial directions to a support structure, the engine unit including a turbine engine portion coupled to a gearbox portion about an axial axis, the device comprising:

a first mounting segment to couple to the turbine engine portion;

a second mounting segment to couple to the support structure;

a force determinator configured to determine a force load of the thermally expandable engine unit at an engine running condition at the first mounting segment; and a connecting rod coupled between the first and second mounting segments, the connecting rod including a first end pivotably coupled to the first mounting segment, a second end pivotably coupled to the second mounting segment to permit axial movement of the thermally expandable structure along an axial axis during thermal expansion, and an adjustable length that is modified to a desired length to correspond to the force load at the engine running condition at the first mounting segment to substantially align the gearbox portion and the turbine engine portion relative to the axial axis.

16. The device of claim 15, wherein the couplings between the connecting rod and the first and second mounting segments are configured to inhibit radial movement of the engine unit during thermal expansion of the engine unit.

17. The system of claim 15, wherein adjustment of the length of the connecting rod is configured to vary a response of the device to the force load.

18. The system of claim 15, wherein the force determinator is removably attached to the aft mounting device.

19. The system of claim 15, wherein the force determinator includes a strain gauge.

20. The system of claim 1, wherein the force determinator includes a strain gauge.

* * * * *